US007857915B2

(12) United States Patent
Kumano et al.

(10) Patent No.: US 7,857,915 B2
(45) Date of Patent: Dec. 28, 2010

(54) GRAIN-ORIENTED ELECTRICAL STEEL SHEET EXTREMELY EXCELLENT IN MAGNETIC PROPERTIES AND METHOD OF PRODUCTION OF SAME

(75) Inventors: Tomoji Kumano, Kitakyushu (JP); Kenichi Murakami, Futtsu (JP); Yoshiyuki Ushigami, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 204 days.

(21) Appl. No.: 11/921,369

(22) PCT Filed: May 19, 2006

(86) PCT No.: PCT/JP2006/310510

§ 371 (c)(1),
(2), (4) Date: Nov. 30, 2007

(87) PCT Pub. No.: WO2006/132095

PCT Pub. Date: Dec. 14, 2006

(65) Prior Publication Data

US 2009/0044881 A1 Feb. 19, 2009

(30) Foreign Application Priority Data

Jun. 10, 2005 (JP) ..... 2005-171419

(51) Int. Cl.
*H01F 1/147* (2006.01)
*H01F 1/18* (2006.01)

(52) U.S. Cl. ..... 148/111; 148/308

(58) Field of Classification Search ..... None
See application file for complete search history.

(56) References Cited

U.S. PATENT DOCUMENTS 5,512,110 A * 4/1996 Yoshitomi et al. ..... 148/113

(Continued)

FOREIGN PATENT DOCUMENTS

JP 59-056522 4/1984

(Continued)

OTHER PUBLICATIONS

T. Kumano, et al., "*Influence of Primary Recrystallization Texture through Thickness to Secondary Texture on Grain Oriented Silicon Steel*," ISIJ International 43(3): 400-409 (2003).

(Continued)

*Primary Examiner*—John P Sheehan
(74) *Attorney, Agent, or Firm*—Kenyon & Kenyon LLP

(57) ABSTRACT

Reheating a grain-oriented electrical steel sheet slab comprising predetermined components to 1280° C. or more and a solid solution temperature of inhibitor substances or more, hot rolling, annealing, and cold rolling it, decarburization annealing it, nitriding it in a strip running state, coating an annealing separator, and finish annealing it during which making a precipitation ratio of N as AlN after hot rolling 20% or less, making a mean grain size of primary recrystallization 7 μm to less than 20 μm, and making a nitrogen increase ΔN in the nitridation within a range of Equation (1) and making nitrogen contents σN1 and σN2 (front and back, mass %) of a 20% thickness portion of one surface of the steel strip (sheet) within a range of Equation (2):

$$0.007-([N]-14/48\times[Ti])\leqq\Delta N\leqq[solAl]\times14/27-([N]-14/48\times[Ti])+0.0025 \quad \text{Equation (1)}$$

$$|\sigma N1-\sigma N2|/\Delta N\leqq0.35 \quad \text{Equation (2).}$$

8 Claims, 2 Drawing Sheets

U.S. PATENT DOCUMENTS

| | | | | |
|---|---|---|---|---|
| 5,679,178 | A * | 10/1997 | Komatsubara et al. | 148/113 |
| 2002/0007870 | A1* | 1/2002 | Ohata et al. | 148/111 |
| 2005/0217761 | A1* | 10/2005 | Ushigami et al. | 148/111 |

FOREIGN PATENT DOCUMENTS

| | | | |
|---|---|---|---|
| JP | 60-177131 | | 9/1985 |
| JP | 01-290716 | | 11/1989 |
| JP | 02-182866 | | 7/1990 |
| JP | 05-112827 | | 5/1993 |
| JP | 05-295443 | | 11/1993 |
| JP | 07-252532 | | 10/1995 |
| JP | 07-305116 | | 11/1995 |
| JP | 8-255843 | A | 9/1996 |
| JP | 08-253815 | | 10/1996 |
| JP | 08-279408 | | 10/1996 |
| JP | 09-118964 | | 5/1997 |
| JP | 9-268321 | A | 10/1997 |
| JP | 10-110218 | A | 4/1998 |
| JP | 2000-199015 | | 7/2000 |
| JP | 2001-152250 | | 6/2001 |

OTHER PUBLICATIONS

Y. Yoshitomi, et al., "*Coincidence Grain Boundary and Role of Primary Recrystallized Grain Growth on Secondary Recrystallization Texture Evolution in Fe-3% Si Alloy*," Acta Metall. Mater. 42(8): 2593-2602 (1994).

"*History and Recent Development of Grain Oriented Electrical Steel at Kawasaki Steel*," Kawasaki Steel Technical Report 29(3): 129-135 (1997).

* cited by examiner

GRAIN-ORIENTED ELECTRICAL STEEL SHEET EXTREMELY EXCELLENT IN MAGNETIC PROPERTIES AND METHOD OF PRODUCTION OF SAME

TECHNICAL FIELD

The present invention relates to a method for producing grain-oriented electrical steel sheet used mainly as a core of a transformer etc.

BACKGROUND ART

Various technologies have been proposed for stably producing a grain-oriented electrical steel sheet excellent in magnetic properties having a magnetic flux density $B_8$ (magnetic flux density in magnetic field of 800 A/m) exceeding 1.9 T. The methods of production in the case containing Al as an inhibitor can be classified into the first to third, that is, three types of, technologies shown in Table 1 according to the slab heating temperature.

ing furnace, 4) giant edge cracks are easily formed in the steel strip after hot rolling, and so on.

Further, in this technology, as disclosed in ISIJ International, Vol. 43 (2003), No. 3, pp. 400 to 409, Acta Metall., 42 (1994), 2593, KAWASAKI STEEL TECHNICAL REPORT, Vol. 29 (1997)3, 129-135, it is widely known that the Goss orientation sharpness deteriorates when performing nitridation after decarburization annealing up to the start of the secondary recrystallization in order to supplement the inhibitors. Further, it is well known that poor secondary recrystallization occurs when an amount of nitrogen is small at the time of melting.

The second technology is a (sufficient) precipitation nitridation type. As disclosed in Japanese Patent Publication (A) No. 59-56522, Japanese Patent Publication (A) No. 5-112827, Japanese Patent Publication (A) No. 9-118964 etc., this performs the slab heating at a temperature less than 1280° C. and performs the nitridation from after the decarburization annealing to the start of the secondary recrystallization.

TABLE 1

| | Class | Slab reheating temp. | Nitridation | Sharpness of Goss Orientation | Remark |
|---|---|---|---|---|---|
| First | Complete solid solution, nonnitridation type | ≧1300° C. | Prohibited | Good | Conventional method |
| Second | Sufficient precipitation, nitridation type | <1280° C. | Essential | Fair | |
| Third | Partial precipitation, nitridation type | 1200 to 1350° C. | Essential | Industrialization hard | |
| | Complete solid solution, large nitridation type | | Essential | Good | |
| Fourth | Complete solid solution, small nitridation type | ≧1280° C. | Essential | Very good | Present invention |

The first technology is the complete solid solution nonnitridation type, that is, a method of heating a slab from 1350° C. to an ultra-high temperature of 1450° C. at the highest, then holding the slab at that temperature for a time long enough to uniformly heat (soak) the entire slab. This causes the MnS, AlN, and other substances having inhibitor capabilities to completely dissolve and causes them to function as the inhibitors required for secondary recrystallization. This complete solid-solubilization simultaneously becomes a means for eliminating the difference in inhibitor strength due to the slab position as well and, in this point, is advantageous for realizing stable secondary recrystallization.

In the case of this technology, however, irrespective of the fact that the complete solid-solubilization temperature for securing the amount of inhibitor required for secondary recrystallization is not that high thermodynamically, in actual industrial production, the temperature cannot help becoming an ultra-high temperature in order to secure productivity and a uniform solid solution state of the slab as a whole. Improvement has been attempted, but actual production involves a variety of problems. For example, 1) securing the hot rolling temperature is difficult according to the position and when it cannot be secured, in-slab deviation of the inhibitor strength occurs, therefore poor secondary recrystallization occurs, 2) coarse grains are easily formed at the time of slab heating, the coarse grain parts cannot be secondary recrystallized, and streak-like poor secondary recrystallization occurs, 3) the slab surface layer melts and becomes molten slag and enormous labor becomes necessary for maintenance of the heat- In this method, as shown in for example Japanese Patent Publication (A) No. 2-182866, control of the mean grain size of primary recrystallized grains after the decarburization annealing to within a content range, usually a range from 18 to 35 μm, is very important for performing the secondary recrystallization well.

Further, the amount of substances having an inhibitor capability in solid solution in the steel exerts a large influence upon the growth potential of primary recrystallized grains. Therefore, in this technology, in order to make sizes of the primary recrystallized grains in the steel sheet uniform, for example, Japanese Patent Publication (A) No. 5-295443 discloses a method of making the solute nitrogen at the time of the slab heating low to suppress non-uniform precipitation occurring in a later process. From the viewpoint of reduction of the amount of solid solution, the actual slab heating temperature is desirably 1150° C. or less.

In this technology, however, no matter how strictly the chemical compositions are adjusted, the inhibitor substances cannot be left completely coarsely precipitated as they are, so the primary recrystallized grain size tends not to be constant. Therefore, in actual production activities, in order to obtain a suitable primary recrystallized grain size, the conditions of the primary recrystallization annealing (particularly the temperature) are adjusted for each coil. For this reason, the production process becomes troublesome. Further, the formation of the oxide layer in the decarburization annealing is not constant. Therefore, sometimes poor formation of the glass film occurs.

The third technology is the mixed type. As shown in Japanese Patent Publication (A) No. 2000-199015, the slab heating temperature is set to 1200 to 1350° C. and the nitridation is made essential in the same way as the second technology. In order to avoid the ultra-high slab heating temperature exceeding 1350° C. in the first technology, the slab heating temperature is lowered. The insufficient inhibitor strength along with this is made up for by the nitridation. This technology is further classified into two types.

One is the partial solid solution nitridation type (partial precipitation nitridation type), and the other is the complete solid solution nitridation type as represented by Japanese Patent Publication (A) No. 2001-152250. In the former, it is not easy to make the solid solution state industrially uniform in the steel sheet (coil) as a whole. On the other hand, in the latter, the contents of the inhibitor elements are reduced to enable the elements to enter solid solution, therefore a non-uniform state of inhibitors seldom occurs. This is a very logical and effective technology.

This third technology classifies inhibitors into a primary inhibitor for determining the primary recrystallized grain size and a secondary inhibitor for making the secondary recrystallization possible. The primary inhibitor naturally contributes to the secondary recrystallization as well. Due to the presence of the primary inhibitor, the fluctuation in grain size after the primary recrystallization becomes small. Particularly, in the latter complete solid solution type, the primary recrystallized grain size does not change in the usual temperature range, therefore, it is not necessary to change the primary recrystallization annealing conditions for adjustment of the grain size, and the glass film is formed extremely stably.

As the primary inhibitor, the inhibitor substances used in the first technology (for example, AlN, MnS, MnSe, Cu—S, Sn, Sb, etc.) are mainly used. However, to reduce the slab heating temperature, their contents are required to be small. The secondary inhibitor is the AlN which is formed nitrided and these primary inhibitors after the decarburization annealing and up to the start of the secondary recrystallization. Further, the above Japanese Patent Publication (A) No. 2001-152250 also discloses BN as a primary inhibitor. However, N bonds with Al as well, therefore actually sometimes the secondary recrystallization becomes unstable when Al and B are simultaneously contained.

As a problem common to the above three technologies, the fact that the suitable ranges of the contents of the required inhibitor substances (particularly Al and N) are narrower in comparison with the process capability at the time of melting in the steelmaking may be mentioned. Therefore, conventionally, the method of adjusting the production conditions using the acid-soluble Al (hereinafter referred to as "solAl") minus the N equivalent, that is, $Al_R$, as a parameter is disclosed in the first and second technologies.

In the first technology, for example Japanese Patent Publication (A) No. 60-177131 prescribes adjustment of a soaking time or cooling rate of the annealing before the last cold rolling and/or any of the series of process conditions by the $Al_R$ value.

Further, in the second technology, Japanese Patent Publication (A) No. 7-305116 prescribes a ratio of $N_2$ in the atmosphere at the time of the final annealing according to an equation of the $Al_R$. Japanese Patent Publication (A) No. 8-253815 adds Bi and prescribes the temperature of the annealing before the last cold rolling according to the equation of $Al_R$. Japanese Patent Publication (A) No. 8-279408 includes Ti and defines the nitridation amount according to the equation of $Al_R$ considering TiN.

DISCLOSURE OF THE INVENTION

In the case of the third technology, the primary recrystallization annealing temperature dependency of the primary recrystallized grain size is negligibly small. However, if the contents of the inhibitor ingredients, particularly Al and N and further the Ti exerting an influence upon the formation of AlN, fluctuate, sometimes the secondary recrystallization behavior becomes unstable.

When the $Al_R$ is large, in order to secure the magnetic properties, it is necessary to increase the nitridation amount in the later process. The reason for this is currently considered to be as follows. If the $Al_R$ is large, AlN precipitates large after the annealing before the last cold rolling and the primary grain size becomes large, but the effect of the primary inhibitor as the secondary inhibitor becomes strong, therefore the secondary recrystallization start temperature becomes higher. With this as is, the inhibitor strength is not sufficient in terms of quality with respect to the higher temperature, the balance of the grain size and inhibitor is lost, and poor secondary recrystallization results. Therefore, it is necessary to strengthen the secondary inhibitor by the nitridation so as to correspond to the higher secondary recrystallization temperature, and the need arises for increasing the nitridation amount. Namely, if the secondary recrystallization temperature rises, it is necessary to strengthen the inhibitor strength. Further, the degree of change of the inhibitor strength becomes large (the change of strength of the inhibitor is sudden at a high temperature), so coarse inhibitors may become necessary. However, if the nitridation amount is made large, the glass film suffers from defects of metal exposure, and the defect ratio (rejection rate) remarkably increases.

On the other hand, if the $Al_R$ is small, AlN precipitates small after the annealing before the last cold rolling and the primary grain size becomes small, therefore the secondary recrystallization start temperature does not become higher and the nitridation amount may be kept small. However, if $Al_R$ is too small, as disclosed in Non-Patent Document 1, the secondary recrystallization nuclei forming positions spread out over the entire sheet thickness. Therefore, not only the grains of the sharp Goss orientation in the vicinity of the surface layer, but also at the center layer the grains of dispersed-Goss orientation are secondary recrystallized, and the magnetic properties deteriorate.

In this way, if the $Al_R$ changes, the secondary recrystallization behavior and in turn the sharpness of the Goss orientation changes. However, at the melting stage, it is difficult to control the ranges of the ingredients of Al, N, and Ti to narrow ranges, therefore countermeasures for easing the influence of fluctuations of these ingredients have been desired.

The fact that a grain-oriented electrical steel sheet is produced through many processes after hot rolling is well known. In the present invention, the slab heating temperature is not made extremely high or low, production is possible by a conventional hot rolling mill, no special slab heating apparatus is needed, the inhibitor strength is kept content in the processes after the hot rolling even when the ingredients unavoidably fluctuate, and a grain-oriented electrical steel sheet extremely good in magnetic properties can be produced.

The present invention provides a method of production of a grain-oriented electrical steel sheet applying high temperature slab heating using AlN as a main inhibitor of secondary recrystallization which makes effective use of the later process of nitridation prohibited in the past due to deterioration of the magnetic properties and thereby obtains a grain-oriented electrical steel sheet extremely excellent in magnetic characteristics. The present invention comprises the following:

(1) A method of production of a grain-oriented electrical steel sheet extremely excellent in magnetic properties comprising reheating a slab comprising, by mass %, C: 0.025 to 0.10%, Si: 2.5 to 4.0%, Mn: 0.04 to 0.15%, solAl: 0.020 to 0.035%, N: 0.002 to 0.007%, S and Se, as Seq (S equivalents)= S+0.406×Se, 0.010 to 0.035%, Ti≦0.007%, and a balance of Fe and unavoidable impurities to 1280° C. or more and a solid solution temperature of the inhibitor substances or more, hot rolling it to form a hot rolled steel strip, annealing the hot rolled strip and cold rolling it one time or two or more times while intermediate annealing it in between, or omitting the annealing of the hot rolled strip and cold rolling it two or more times while intermediate annealing it in between, decarburization annealing it, nitriding it after the decarburization annealing in a mixed gas of hydrogen, nitrogen, and ammonia in the strip running state, coating an annealing separator mainly consisting of MgO, and applying final annealing, said method of production of a grain-oriented electrical steel sheet characterized by making a ratio of precipitation of the N contained in the steel strip after the hot rolling as AlN 20% or less, making a circle equivalent mean grain size (diameter) of the primary recrystallized grains after completion of the decarburization annealing 7 μm to less than 20 μm, making the nitrogen increase ΔN (mass %) in the nitridation within a range of Equation (1), and making the nitrogen contents σN1 and σN2 (each surface, mass %) of a 20% thickness portion of one surface of the steel sheet (strip) within a range of Equation (2).

$$0.007-([N]-14/48\times[Ti])\leqq\Delta N\leqq[solAl]\times14/27-([N]-14/48\times[Ti])+0.0025 \quad \text{Equation (1)}$$

(wherein, [ ] represent the contents (mass %) of the compositions)

$$|\sigma N1-\sigma N2|/\Delta N\leqq0.35 \quad \text{Equation (2)}$$

(2) A method of production of a grain-oriented electrical steel sheet extremely excellent in magnetic properties as set forth in (1), characterized by making a highest temperature T1 (° C.) of the last annealing of the hot rolled strip annealing and intermediate annealing (hereinafter referred to as the "annealing before the last rolling") 950° C. or more and within a range shown in Equation (4) according to an $AlN_R$ defined in Equation (3) from the solAl, N, and Ti contents:

$$AlN_R=[solAl]-27/14\times[N]+27/48\times[Ti] \quad \text{Equation (3)}$$

$$3850/3-4/3\times AlN_R\times10000\leqq Ti(0°\ C.)\leqq4370/3-4/3\times AlN_R\times10000 \quad \text{Equation (4)}$$

(3) A method of production of a grain-oriented electrical steel sheet extremely excellent in magnetic properties as set forth in (2), characterized by making the temperature of the annealing before the last cold rolling one stage and making the temperature within the range of T1 (° C.) shown in Equation (4) for 20 to 360 seconds.

(4) A method of production of a grain-oriented electrical steel sheet extremely excellent in magnetic properties as set forth in (2) or (3), characterized by making the temperature of the annealing before the last cold rolling two stages, making the temperature in the first stage within the range of T1 (° C.) shown in said Equation (4) for 5 to 120 seconds, and making the temperature in the second stage within a range of from 850 to 1000° C. for 10 seconds to 240 seconds.

(5) A method of production of a grain-oriented electrical steel sheet extremely excellent in magnetic properties as set forth in any one of (1) to (4), characterized by making a cooling rate from 700° C. to 300° C. in cooling of the annealing before the last cold rolling 10° C./sec or more.

(6) A method of production of a grain-oriented electrical steel sheet extremely excellent in magnetic properties as set forth in any one of (1) to (5), characterized in that the slab compositions further include Cu, by mass %, of 0.05 to 0.30%.

(7) A method of production of a grain-oriented electrical steel sheet extremely excellent in magnetic properties as set forth in any one of (1) to (6), characterized in that the slab compositions further include at least one of Sn, Sb, and P, in total of mass %, of 0.02 to 0.30%.

(8) A method of production of a grain-oriented electrical steel sheet extremely excellent in magnetic properties as set forth in any one of (1) to (7), characterized in that the slab compositions further include Cr, by mass %, of 0.02 to 0.30%.

(9) A method of production of a grain-oriented electrical steel sheet extremely excellent in magnetic properties as set forth in any one of (1) to (8), characterized by making a rolling ratio in the last cold rolling is controlled to 80 to 92%.

(10) A method of production of a grain-oriented electrical steel sheet extremely excellent in magnetic properties as set forth in any one of (1) to (9), characterized by holding the steel strip within a temperature range from 100 to 300° C. for 1 minute or more in at least one pass of the last cold rolling.

(11) A method of production of a grain-oriented electrical steel sheet extremely excellent in magnetic properties as set forth in any one of (1) to (10), characterized by making a heating rate from the start of temperature rise in the decarburization annealing up to 650° C. 100° C./sec or more.

(12) A grain-oriented electrical steel sheet characterized in that it is obtained by a method of production method as described in any one of (1) to (11) and has a magnetic flux density $B_8$ in a rolling direction (in an applied field of 800 A/m) of 1.92 T or more.

BEST MODE FOR CARRYING OUT THE INVENTION

Figure 1:
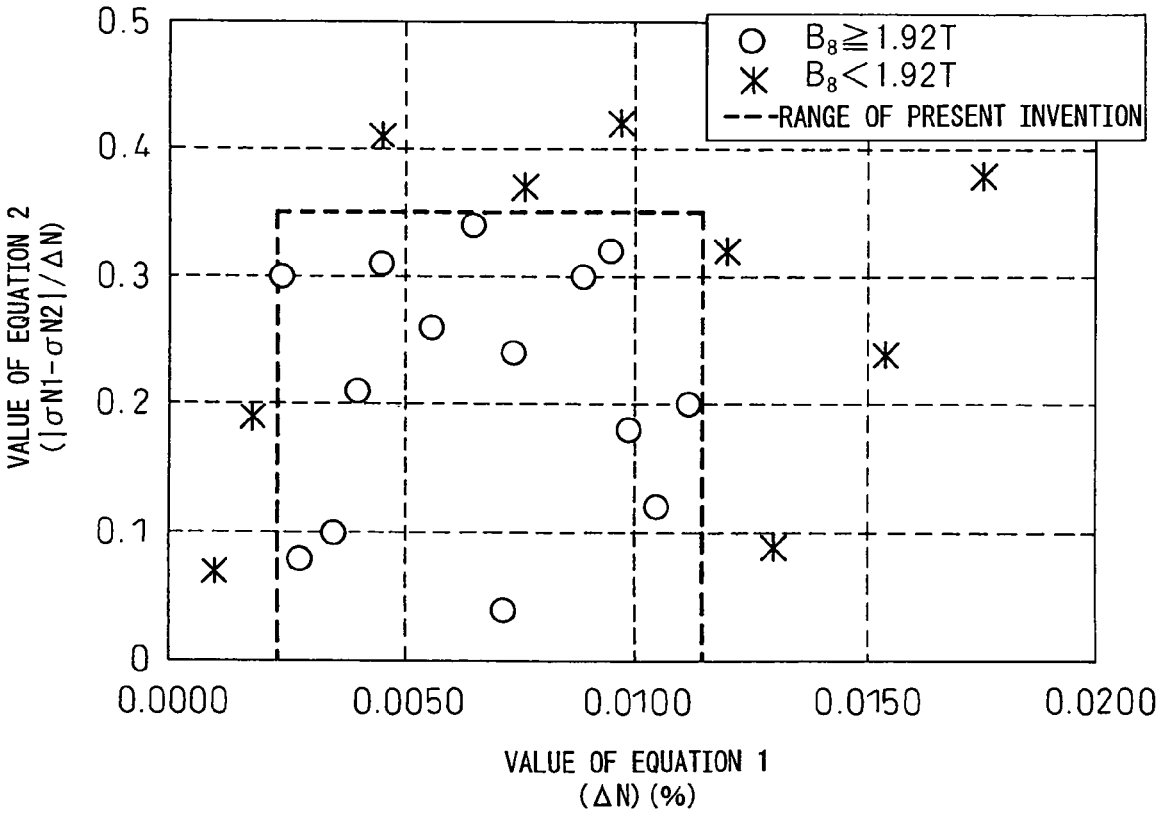
FIG. 1 is a diagram showing the relationship between the values of Equation (1) and values of Equation (2) defined in the present invention.

The present invention will be explained in detail below.

The framework of the present invention resides in reducing the content of N at the time of melting and making up for the resultant insufficient AlN of the secondary inhibitor by nitridation in the first technology where a later process of nitridation had been considered prohibited, that is, a case of slab heating by an ultra-high temperature to make the inhibitor substances completely solid-solute. In this case, in order to obtain an effective inhibitor strength at the nitridation amount, which has to be made low, nitridation at both surfaces of the steel sheet (strip) is made an essential requirement.

Further, by making the inhibitor elements completely solid-solute, the decarburization annealing temperature dependency of the primary recrystallized grain size disappears, therefore there are also the advantages that the decarburization annealing conditions can be set to conditions advantageous to formation of forsterite and formation of a glass film becomes easy.

The characterizing feature of the present invention resides in the point that in the production of high magnetic flux density a grain-oriented electrical steel sheet containing Al, the fluctuation of Al and N at the melting stage is unavoidable and the difficulty of the extremely strict production conditions in industrial production is overcome by nitridation. As such methods, there are the technologies disclosed in Japanese Patent Publication (A) No. 5-112827, Japanese Patent Publication (A) No. 2000-199015, and Japanese Patent Publication (A) No. 2001-152250. The main objects of these technologies are the reduction of the slab heating temperature and the reduction of the glass film defect ratio.

In current industrial production facilities, indisputably the method of using AlN as the main inhibitor gives the sharpest Goss orientation. Particularly, there is a possibility that a high magnetic flux density is obtained for the complete solid solution type between the first technology and the third technology. An object of the technology of the present invention is to absorb unavoidable Al and N fluctuations at the melting stage, the disadvantage of this method, by the annealing conditions before the last cold rolling and the nitridation, and to make the inhibitors multi-staged in the sheet thickness direction by the nitridation so as to further improve the Goss orientation.

In the case of the technology of the present invention, the nitridation amount is small. Therefore, it is made essential that the nitridation be performed with no large difference between both (two) sides of the strip. Note that no upper limit of the slab heating is set, but in practice over 1420° C. is difficult in terms of capabilities of the facilities.

In the first "complete solid solution non-nitridation type" in the above table, it is widely known that where the nitrogen contained at the time of melting is about 0.008%, if nitriding occurs from the decarburization annealing to the start of the secondary recrystallization, the Goss orientation deteriorates. Further, when the nitrogen is small at the time of melting, it is well known that poor secondary recrystallization occurs as well.

Therefore, the inventors engaged in intensive research and development and discovered the following matters:

First, they discovered in the complete solid solution type, by reducing the nitrogen at the time of melting and nitriding the steel in a later process, the inhibitor becomes of two types: an inherent inhibitor finely precipitated by the heat treatment before the decarburization annealing and an acquired inhibitor formed by the nitridation thereof. In addition, when considering the type of the inhibitor as well, the inhibitor sequentially behaves in multiple stages, therefore sharp Goss nuclei were formed in the surface layer in the sheet thickness direction at the time of the secondary recrystallization annealing (final annealing). These were secondary recrystallized with extremely high priority. Due to this, substantially complete control of the secondary recrystallization of Goss orientation became possible. Further, the production of a grain-oriented electrical steel sheet having an extremely high magnetic flux density never before existing became possible.

Further, the inventors discovered that the fluctuations in the amount and quality of the secondary inhibitor occurring due to the unavoidable fluctuations of aluminum and nitrogen in the melting stage could be absorbed by the control of the annealing conditions before the last cold rolling and the nitrogen amount by nitriding.

Note that inhibitors other than AlN such as MnS, MnSe, Cu—S, Cu—Se, etc. have effects for improvement of the Goss orientation sharpness, though auxiliary.

As important magnetic properties in a grain-oriented electrical steel sheet, there are watt loss, magnetic flux density, and magnetostriction. The watt loss can be improved by magnetic domain control technology so long as the Goss orientation sharpness is excellent and the magnetic flux density is high. Magnetostriction can be reduced (made better) as well when the magnetic flux density is high. When the magnetic flux density is high, an excitation current of a transformer can be made relatively small, therefore the size can be made small. Namely, the magnetic properties which must be noted most in the production of a grain-oriented electrical steel sheet is the magnetic flux density. Improvement of this is a major theme of technical development in this field. An object of the present invention is to further improve the magnetic flux density. The invention particularly covers a grain-oriented electrical steel sheet having a magnetic flux density ($B_8$) of 1.92 T or more and a method of production of the same.

Next, the reasons for limitation of the ranges of compositions of the slab in the present invention will be explained. The unit of the content is mass %.

C, if smaller than 0.025%, makes the primary recrystallization texture unsuitable, while if over 0.10%, decarburization becomes difficult, which is not suitable for industrial production.

Si, if smaller than 2.5%, prevents a good watt loss from being obtained, while if over 4.0%, cold rolling becomes extremely difficult, which is not suitable for industrial production.

Mn, if smaller than 0.04%, results in easy cracking after hot rolling, a drop in the yield, and unstable secondary recrystallization. On the other hand, if over 0.15%, the amounts of MnS and MnSe functioning as inhibitors become larger, and the slab heating temperature at the time of the hot rolling must be made high. Further, the degree of solid solution becomes non-uniform according to the position, so there arises a problem in stable production in actual industrial production.

The solAl bonds with N to form AlN and mainly functions as a secondary inhibitor. This AlN includes AlN formed before the nitridation and AlN formed at the time of the high temperature annealing after nitridation. The amount must be 0.020 to 0.035% for securing the amount of both AlNs. When over 0.035%, the slab heating temperature must be made extremely high. Further, when it is contained in an amount less than 0.020%, the Goss orientation sharpness deteriorates.

N is important as an inhibitor in the present invention. By setting the N content slightly lower than that in the prior art in the melting stage predicated on nitridation in the later process, the ultra-high temperature slab heating temperature is avoided. If N exceeds 0.007%, it becomes necessary to make the slab heating temperature over 1350° C. in actual industrial production, and the Goss orientation sharpness deteriorates due to the nitridation in the later process. Further, if less than 0.002%, a stable primary inhibitor effect is not obtained, control of the primary recrystallized grain size becomes difficult, and poor secondary recrystallization results. The upper limit of N at the time of the melting is preferably 0.0065%, more preferably 0.006%, and further preferably 0.0055%. On the other hand, the lower limit is preferably 0.0025%, more preferably 0.003%, and further preferably 0.0035%.

S and Se bond with Mn and Cu and function as inhibitors. Further, these are useful as precipitation nuclei of AlN as well. When $Seq=S+0.406\times Se$ exceeds 0.035%, for the complete solid solution, it becomes necessary to make the slab heating temperature very high. When this is less than 0.010%, the effect as the inhibitor becomes weak, and the secondary recrystallization becomes unstable.

Ti bonds with N to form TiN. When this is contained exceeding 0.007%, the N for forming the AlN is insufficient, the inhibitor strength is not secured and poor secondary recrystallization occurs. Further, the Ti remains in the form of TiN in the final product and deteriorates the magnetic properties (particularly the watt loss).

Cu forms a fine precipitate together with S or Se and exhibits the inhibitor effect in the present invention heating the slab to 1280° C. or more. Further, this precipitate becomes precipitation nuclei making the dispersion of AlN more uniform as well and acts as a secondary inhibitor as well. This effect makes the secondary recrystallization better. When this is smaller than 0.05%, the above effect is reduced. On the other hand, when it exceeds 0.3%, the above effect is saturated and, at the same time, this becomes a cause of surface defect such as "copper scabs" at the time of hot rolling.

Sn, Sb, and P are effective for the improvement of the primary recrystallization texture. Further, it is known that S, Sb, and P are grain boundary segregation elements and have an effect of stabilizing the secondary recrystallization. When the total amount of these is less than 0.02%, this effect is extremely small. On the other hand, when this exceeds 0.30%, these elements are hard to oxidize at the time of the decarburization annealing, the formation of the glass film becomes insufficient, and the surface property (after the decarburization annealing is remarkably hindered.

Cr is effective for making formation of a forsterite film (primary film, glass film) good. When this is less than 0.02%, this effect is extremely small. On the other hand, when it exceeds 0.30%, the element is hard to oxidize at the time of the decarburization annealing, and the formation of the glass film becomes insufficient.

For other elements, addition within known ranges for the improvement of the characterizing features of a grain-oriented electrical steel sheet is not prevented. For example, Ni has a remarkable effect for uniform dispersion of precipitates functioning as the primary and secondary inhibitors. The magnetic properties are further good and stabilized. When the amount is smaller than 0.02%, this effect does not exist. When this exceeds 0.3%, it becomes hard to oxidize at the time of the decarburization annealing, and the formation of the glass film becomes difficult.

Further, Mo and Cd form a sulfide or selenide and contribute to the strengthening of the inhibitor. However, when the amount is less than 0.008%, there is no effect, while when the amount exceeds 0.3%, the precipitates become coarse, the function of the inhibitor is not obtained, and the magnetic properties do not become stable.

Next, the production process in the present invention and the reasons for the limitation thereof will be explained.

For casting for obtaining a slab, the conventional continuous casting method may be applied, but the ingot casting method may be applied as well in order to facilitate the slab heating. In this case, it is known that the carbon content can be reduced. Specifically, a slab having an initial thickness within a range from 150 mm to 300 mm, preferably a range from 200 mm to 250 mm, is produced according to a known continuous casting method. In place of this, the slab may be a so-called thin slab having an initial thickness within a range from about 30 mm to 70 mm as well. In these cases, when producing a hot rolled steel strip, there is the advantage that there is no need for rough rolling to an intermediate thickness.

The condition of the slab heating temperature preceding the hot rolling is an important point of the present invention. The slab heating temperature must be 1280° C. or more to make the inhibitor substances solid-solute (made solid solute). If the temperature is less than 1280° C., the precipitation states of the inhibitor substances in the slab (or hot rolled steel strip) become non-uniform and so-called skid marks are formed in the final product. Preferably, this is 1290° C. or more, more preferably 1300° C. or more and 1310° C. or more. The upper limit is not particularly set, but is about 1420° C. industrially.

It has become possible to perform this complete solid solution treatment without raising the temperature up to an ultra-high temperature of 1420° C. due to the progress in induction heating and other equipment technologies in recent years. Naturally, as the heating method in the hot rolling in industrial production, in addition to an ordinary gas heating method, induction heating and direct electric resistance heating may also be used. In order to secure a shape for these special heating methods, there is no problem even if breaking down (slabbing) the cast slab. Further, in a case where the heating temperature becomes a high 1300° C. or more, this breakdown may be used to improve the texture to reduce the C amount. These are within the range of conventional known technologies.

In recent years, to supplement ordinary continuous hot rolling, thin slab casting and steel strip casting (strip caster) have been put into practical use. The present invention does not obstruct application of these. However, as a practical problem, in these, so-called "center segregation" occurs at the time of solidification making it difficult to obtain a completely uniform solid solution state. In order to obtain a completely uniform solid solution state, it is strongly desired to perform the solid solution heat treatment once before obtaining the hot rolled steel strip.

If the precipitation ratio of the N as AlN in the hot rolled steel strip exceeds 20%, the size of the precipitates after the annealing before the last cold rolling becomes large and the amount of the fine precipitates functioning as the effective inhibitor is reduced, therefore the secondary recrystallization property becomes unstable. The precipitation ratio can be adjusted by the cooling after the hot rolling. If making the cooling start temperature higher and making the cooling rate faster, the precipitation ratio becomes lower. The lower limit of the precipitation ratio is not particularly defined, but in practice it is difficult to make the precipitation ratio less than 3%.

Figure 2:
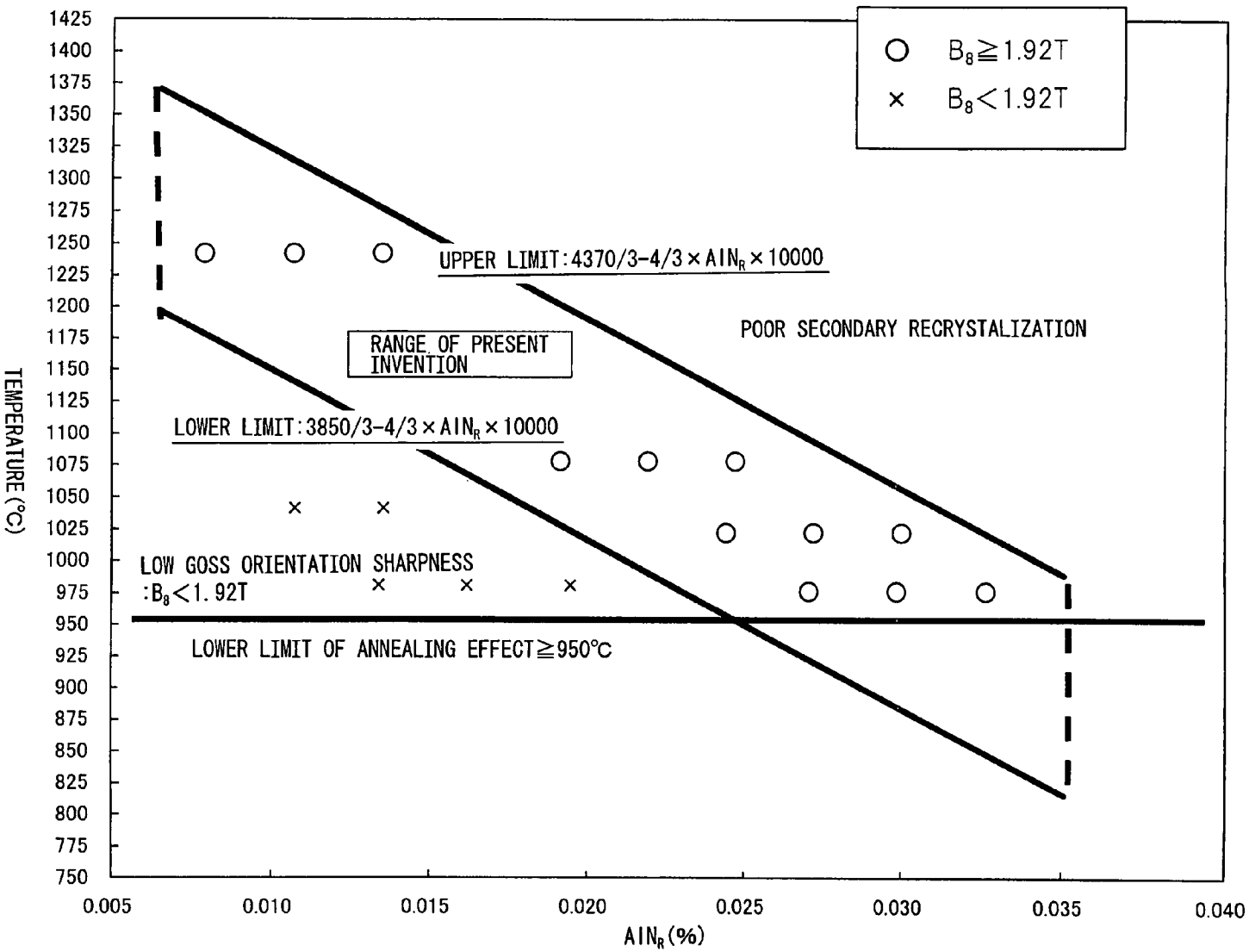
FIG. 2 is a diagram showing the relationship between $AlN_R$ and an annealing temperature.

The annealing after the last cold rolling is usually carried out mainly for homogenizing the texture in the steel strip formed at the time of the hot rolling and for the precipitation/fine dispersion of the inhibitors. In the case of single cold rolling, this is annealing of the hot rolled steel strip, while in the case of two or more cold rollings, this becomes the annealing before the last cold rolling. The highest temperature in this case exerts a large influence upon the inhibitors. Namely, where it is relatively low, the primary recrystallized grain size is small, while when the temperature is high, the grain becomes large. Further, in order to obtain a good Goss orientation texture, the relationship between this temperature and the nitridation amount is important. Specifically, preferably the temperature is set within the range of T1 (° C.) given by Equation (4) in accordance with the value of $AlN_R$ (mass %) defined in Equation (3). As shown in FIG. 2, when T1 (° C.) is less than Equation (4), the Goss orientation sharpness is poor, and $B_8$ does not exceed 1.92 T. Further, in the case of a temperature where T1 (° C.) exceeds Equation (4), poor secondary recrystallization results. Note that when T1 (° C.) is less than the lower limit 950° C., there is no effect of annealing, particularly, there is no effect for the improvement of the texture. On the other hand, sometimes the upper limit is set for the equipment specification in actual operation. Generally, annealing under a temperature condition exceeding 1275° C. is difficult in terms of industry.

$$AlN_R=[solAl]-27/14\times[N]+27/48\times[Ti] \quad \text{Equation (3)}$$

$$3850/3-4/3\times AlN_R\times 10000 \leqq Ti(^\circ C.) \leqq 4370/3-4/3\times AlN_R\times 10000 \quad (4)$$

As a particularly preferred method, preferably the temperature of annealing is set at one stage (one level of temperature) and that temperature is held within the range of T1 (° C.) shown in the above Equation (4) for 20 to 360 seconds or the annealing temperature is set at two stages (two levels of temperature), the temperature in the first stage is held within the range of T1 (° C.) shown in the above Equation (4) for 5 to 120 seconds, and the temperature in the second stage is held within a range from 850 to 1000° C. for 10 seconds to 240 seconds.

In the cooling after the annealing before the last cold rolling, in order to secure the fine inhibitors and secure a martensite or bainite phase or other quenched hard phase, the cooling rate from 700° C. to 300° C. is preferably made 10° C./sec or more.

When the last cold rolling ratio in the cold rolling is less than 80%, the Goss orientation ({110}<001>) in the primary recrystallization texture is broad, and further the intensity of Σ9 to Goss orientation becomes weak, therefore a high magnetic flux density is not obtained. Further, when it exceeds 92%, the Goss orientation intensity ({110}<001>) in the primary recrystallization texture becomes extremely weak, and the secondary recrystallization becomes unstable.

The last cold rolling may be performed at ordinary temperature, but it is known that the primary recrystallization texture is improved and the magnetic properties become extremely good when at least 1 pass is performed holding the steel within a temperature range from 100 to 300° C. for 1 minute or more.

Regarding the mean grain size (diameter of circle equivalent area) of the primary recrystallized grains after the decarburization annealing, in for example Japanese Patent Publication (A) No. 07-252532, the mean grain size of the primary recrystallized grains is made 18 to 35 μm. In the present invention, however, it is necessary to make the mean grain size of primary recrystallized grains 7 μm to less than 20 μm. This is an extremely important point in the present invention for making the magnetic properties (particularly the watt loss) good. Namely, if the primary recrystallized grain size is small, from the viewpoint of the texture as well, the volume percentage of Goss orientation grains becoming nuclei of the secondary recrystallization becomes large in the stage of the primary recrystallization.

Further, since the primary recrystallized grain size is small, the number of Goss nuclei is relatively large as well. The absolute number thereof increases about quintuple in the case of the present invention compared with the case where the mean radius of the primary recrystallized grains is 18 to 35 μm, therefore the secondary recrystallized grain size becomes relatively small as well. As a result of this, the watt loss is remarkably improved.

Further, the start of the secondary recrystallization occurs near the surface layer of the sheet thickness, but when the primary recrystallized grain size is small, the selectivity in the sheet thickness direction of the Goss secondary recrystallization nucleus growth increases, and the Goss secondary recrystallization texture becomes sharp.

When the grain size is less than 7 μm, the secondary recrystallization temperature is extremely lowered, and the Goss orientation sharpness becomes poor. When the grain size becomes 20 μm or more, the secondary recrystallization temperature rises, and the secondary recrystallization becomes unstable. Usually, as the primary recrystallized grain size, when the slab heating temperature is made 1280° C. or more and the inhibitor substances are made completely solid-solute, even if the annealing temperature before the last cold rolling and the decarburization annealing temperature are changed, the grain size substantially becomes within a range of 9 μm to less than 20 μm.

In the present invention, in comparison with the technology of the sufficient precipitation nitridation type (second technology), the mean grain size of the primary recrystallized grains is made small, and the nitridation amount is made small. Due to these, the driving force for grain boundary movement (grain growth: secondary recrystallization) becomes larger and the secondary recrystallization starts in an earlier stage in the temperature heating up stage of the last final annealing (at a lower temperature). Due to this, in actual circumstances where the secondary recrystallization annealing is carried out in a coil state by box type annealing, with the method of causing secondary recrystallization in a constant heating up rate, the temperature histories of the different positions of the coil are similar, so the non-uniformity of magnetic properties according to coil positions of the secondary recrystallization is remarkably reduced, and the magnetic properties are stabilized to an extremely high level.

The decarburization annealing is carried out under known conditions, that is, at 650 to 950° C. for 60 to 500 seconds in accordance with the strip (sheet) thickness as well, preferably for 80 to 300 seconds in a nitrogen and hydrogen mixed wet atmosphere. At this time, if the heating rate from the start to the temperature up to 650° C. is made 100° C./sec or more, the primary recrystallization texture is improved and the magnetic properties become good. In order to secure the heating rate, various methods may be considered. Namely, there are electrical resistance heating, induction heating, directly energy input heating, and so on.

If the heating speed is made fast, the amount of Goss orientation is enriched in the primary recrystallization texture and the secondary recrystallized grain size becomes smaller as known by Japanese Patent Publication (A) No. 1-290716 etc.

Applying nitridation to the steel sheet after the decarburization annealing and before the start of the secondary recrystallization is essential in the present invention. As that method, a method of mixing a nitride (CrN, MnN, etc.) with the annealing separator at the time of the high temperature annealing and a method of nitridation in a mixed gas of hydrogen, nitrogen, and ammonia in a state where the strip is run after the decarburization annealing are known. Either method can be employed, but the latter method is practical in industrial production, so the present invention is limited to the latter.

The nitridation is to secure the N to be bonded with the acid-soluble Al and secure the inhibitor strength. If the amount thereof is small, the secondary recrystallization becomes unstable. Further, if the amount is large, the Goss orientation sharpness extremely deteriorates and defects of exposure of the ground iron (matrix) in the primary film frequently occur.

The upper limit of the nitrogen amount after the nitridation must be the amount exceeding the N of the Al equivalent as AlN. The reason for this is not yet clear, but the inventors think as follows. When the temperature becomes high during the secondary recrystallization annealing, the AlN functioning as the inhibitor dissolves and go into solid solution to be weakened. In this case, however, since diffusion of N is easy, if the content (nitridation amount) is small, this weakening is fast, and the secondary recrystallization becomes unstable. In this way, for thermal stabilization of the inhibitor, N larger than the AlN equivalent is necessary. In this case, Al is sufficiently fixed, therefore the weakening of the inhibitor is slow, and the selective growth of the Goss secondary recrystallization nuclei is secured extremely largely. By combining the above influences, the nitridation amount ΔN (mass %) is adjusted within the range defined in the following Equation (1).

$$0.007-([N]-14/48\times[Ti])\leqq\Delta N\leqq[solAl]\times14/27-([N]-14/48\times[Ti])+0.0025 \quad \text{Equation (1)}$$

(where, [ ] indicates the content (mass %) of a composition)

This nitridation must be performed so that there is no large difference between the two surfaces. In the sufficient precipitation nitridation type (second technology), the primary recrystallized grain size is large and the nitridation amount is large as well, therefore the secondary recrystallization start temperature becomes a higher one of more than 1000° C. Therefore, even in the case of nitridation from substantially one surface, so far as the nitridation amount is secured, N is diffused at a high temperature, the inhibitor strength in the sheet (strip) thickness direction can be secured, and there is no trouble in the secondary recrystallization. However, the magnetic characteristics are not excellent, and defects in the primary film easily occur. On the other hand, in the present invention, the primary recrystallized grain size is small and the nitridation amount is small, therefore the secondary recrystallization start temperature becomes a lower 1000° C. or less. For this reason, in order to obtain a good Goss orientation secondary recrystallization texture, it becomes necessary to secure the inhibitor in the entire sheet (strip) thickness direction promptly. It is necessary to diffuse N in an early stage for this purpose. Accordingly, in order to reliably achieve this, it becomes essential to prevent occurrence of a large difference of nitridation amount between the two surfaces. Otherwise, poor secondary recrystallization occurs.

As a concrete method of nitriding both surfaces in almost equal amounts, the strip is run in a uniform ammonia concentration atmosphere. Note that a strip has a width exceeding 1 m. Therefore, in order to make the ammonia concentrations above and below the same content, it is necessary to sufficiently investigate means for supplying the ammonia.

Specifically, the nitrogen contents σN1 and σN2 (both sides, mass %) of a 20% thickness portion of one surface of the steel sheet (strip) are controlled within the range of Equation (2).

$$|\sigma N1-\sigma N2|/\Delta N\leqq0.35 \quad \text{Equation (2)}$$

After the nitridation, according to a known method, an annealing separator mainly consisting of MgO is coated, then the final annealing is applied. Usually, after that, the steel is coated with an insulation tension coating and flattened to form the final product.

EXAMPLES

Example 1

A slab comprising the molten steel chemical compositions shown in Table 2 produced by an ordinary method was reheated within a range from 1230 to 1380° C., then, particularly in order to suppress the precipitation of AlN as much as possible, was hot rolled ended at as high a temperature as possible and was rapidly cooled. In this way, a hot rolled steel strip having a thickness of 2.3 mm was obtained. Then, the hot rolled steel strip was continuously annealed at the annealing temperature shown in Table 2 for 60 seconds and cooled at a rate of 20° C./sec. After that, it was rolled at a temperature of 200° C. to 250° C. to obtain a thickness of 0.285 mm. After that, it was annealed, both for decarburization and primary recrystallization, at 850° C. for 150 seconds in a mixed atmosphere of $H_2$ and $N_2$ at a dew point of 65° C., then was nitrided while running the steel strip in an ammonia-containing atmosphere. After that, the strip was coated with an annealing separator mainly consisting of MgO, then was annealed by secondary recrystallization annealing. The secondary recrystallization annealing was performed in an atmosphere of $N_2$=25% and $H_2$=75% by heating up the temperature up to 1200° C. at a rate of 10 to 20° C./hour. After that, the strip was purified at a temperature of 1200° C. for 20 hours or more in an atmosphere of $H_2$=100%. After that, the strip was coated with the usually used insulation tension coating and then flattened. The results are shown in Table 2 and Table 3 (continuation of Table 2). As shown in Table 2 and Table 3, the steels of the present invention had high magnetic properties, particularly high $B_8$.

TABLE 2

| | | Chemical compositions at melting (mass %) | | | | | | | | | | | | |
|---|---|---|---|---|---|---|---|---|---|---|---|---|---|---|
| No. | Class | C | Si | Mn | S | Se | Cu | sAl | N | Sn | Sb | Mo | Ti | $AlN_R$ |
| 1 | Inv. ex. | 0.070 | 3.45 | 0.075 | 0.024 | — | 0.10 | 0.0265 | 0.0050 | 0.12 | — | — | 0.0010 | 0.0174 |
| 2 | Comp. ex. | 0.070 | 3.45 | 0.075 | 0.024 | — | 0.10 | 0.0265 | 0.0050 | 0.12 | — | — | 0.0010 | 0.0174 |
| 3 | Comp. ex. | 0.070 | 3.45 | 0.075 | 0.024 | — | 0.10 | 0.0265 | 0.0050 | 0.12 | — | — | 0.0010 | 0.0174 |
| 4 | Comp. ex. | 0.070 | 3.45 | 0.075 | 0.024 | — | 0.10 | 0.0265 | 0.0050 | 0.12 | — | — | 0.0010 | 0.0174 |
| 5 | Comp. ex. | 0.070 | 3.45 | 0.075 | 0.024 | — | 0.10 | 0.0265 | 0.0050 | 0.12 | — | — | 0.0010 | 0.0174 |
| 6 | Inv. ex. | 0.075 | 3.30 | 0.072 | 0.005 | 0.020 | 0.11 | 0.0275 | 0.0045 | — | 0.040 | 0.01 | 0.0015 | 0.0197 |
| 7 | Comp. ex. | 0.075 | 3.30 | 0.072 | 0.005 | 0.020 | 0.11 | 0.0275 | 0.0045 | — | 0.040 | 0.01 | 0.0015 | 0.0197 |
| 8 | Comp. ex. | 0.075 | 3.30 | 0.072 | 0.005 | 0.020 | 0.11 | 0.0275 | 0.0045 | — | 0.040 | 0.01 | 0.0015 | 0.0197 |
| 9 | Comp. ex. | 0.075 | 3.30 | 0.072 | 0.005 | 0.020 | 0.11 | 0.0275 | 0.0045 | — | 0.040 | 0.01 | 0.0015 | 0.0197 |
| 10 | Comp. ex. | 0.075 | 3.30 | 0.072 | 0.005 | 0.020 | 0.11 | 0.0275 | 0.0045 | — | 0.040 | 0.01 | 0.0015 | 0.0197 |
| 11 | Inv. ex. | 0.068 | 3.38 | 0.070 | 0.018 | 0.011 | 0.08 | 0.0280 | 0.0052 | 0.10 | 0.035 | — | 0.0035 | 0.0199 |
| 12 | Comp. ex. | 0.069 | 3.35 | 0.072 | 0.017 | 0.012 | 0.10 | 0.0276 | 0.0051 | 0.09 | 0.034 | — | 0.0080 | 0.0223 |

TABLE 3

(continuation of Table 2)

| No. | Slab reheating temperature (° C.) | AlN precipitation ratio after hot rolling (%) | Hot rolled strip annealing temperature (° C.) | Total nitridation amount ΔN (%) | Front surface nitridation amount σN1 (%) | Back surface nitridation amount σN2 (%) | Both surfaces nitridation ratio | Magnetic properties $B_8$(T) | Magnetic properties $W_{17/50}$(W/kg) |
|---|---|---|---|---|---|---|---|---|---|
| 1 | 1350 | 8.0 | 1120 | 0.0040 | 0.0021 | 0.0015 | 0.15 | 1.956 | 0.91 |
| 2 | 1350 | 8.0 | 1120 | 0.0145 | 0.0070 | 0.0050 | 0.14 | 1.881 | 1.13 |
| 3 | 1230 | 23.5 | 1120 | 0.0040 | 0.0023 | 0.0017 | 0.15 | Magnetic failure: Skid marks | |
| 4 | 1350 | 8.0 | 1120 | 0.0100 | 0.0065 | 0.0025 | 0.40 | Poor secondary recrystallization | |
| 5 | 1350 | 8.0 | 1270 | 0.0040 | 0.0017 | 0.0011 | 0.15 | Poor secondary recrystallization | |
| 6 | 1360 | 7.5 | 1100 | 0.0045 | 0.0020 | 0.0014 | 0.13 | 1.961 | 0.90 |
| 7 | 1360 | 7.5 | 1100 | 0.0135 | 0.0066 | 0.0048 | 0.13 | 1.892 | 1.10 |
| 8 | 1270 | 28.0 | 1100 | 0.0045 | 0.0019 | 0.0013 | 0.13 | Magnetic failure: Skid marks | |
| 9 | 1360 | 7.6 | 1100 | 0.0050 | 0.0034 | 0.0014 | 0.40 | Poor secondary recrystallization | |
| 10 | 1360 | 7.5 | 1220 | 0.0035 | 0.0019 | 0.0014 | 0.14 | Poor secondary recrystallization | |
| 11 | 1370 | 7.0 | 1080 | 0.0048 | 0.0023 | 0.0018 | 0.10 | 1.955 | 0.93 |
| 12 | 1375 | 8.0 | 1080 | 0.0048 | 0.0025 | 0.0020 | 0.10 | Poor secondary recrystallization | |

Example 2

A slab comprising the molten steel chemical compositions shown in Table 3 produced by an ordinary method was reheated within a range from 1240 to 1350° C. to make the inhibitor substances completely go into solid solution once, then, particularly in order to suppress the precipitation of AlN as much as possible, was hot rolled ended at as high a temperature as possible and was rapidly cooled. In this way, a hot rolled steel strip having a thickness of 2.3 mm was obtained. Then, the hot rolled steel strip was continuously annealed at the highest temperature shown in Table 3 for 30 seconds and then at 930° C. for 60 seconds and cooled at a rate of 20° C./sec. After that, it was hot rolled at a temperature of 200° C. to 250° C. to 0.22 mm. After that, it was decarburization annealed at 850° C. for 110 seconds in a mixed atmosphere of $H_2$ and $N_2$ at a dew point of 65° C., then was nitrided while running the steel strip in an ammonia atmosphere. After that, the strip was coated with an annealing separator mainly consisting of MgO, then was annealed by secondary recrystallization annealing. The secondary recrystallization annealing was performed in an atmosphere of $N_2$=25% and $H_2$=75% by heating up the temperature to 1200° C. at a rate of 10 to 20° C./hour. After that, the strip was purified at a temperature of 1200° C. for 20 hours or more in an atmosphere of $H_2$=100%. After that, the strip was coated with the usually used insulation tension coating and then flattened. The results are shown in Table 4 and Table 5 (continuation of Table 4). As shown in Table 4 and Table 5, the steels of the present invention had high magnetic properties, particularly high $B_8$.

TABLE 4

| No. | Class | Chemical compositions at melting (mass %) C | Si | Mn | S | Se | Cu | sAl | N | Sn | Sb | Mo | Ti | $AlN_R$ |
|---|---|---|---|---|---|---|---|---|---|---|---|---|---|---|
| 1 | Inv. ex. | 0.074 | 3.42 | 0.074 | 0.023 | — | 0.15 | 0.0260 | 0.0051 | 0.13 | — | — | 0.0015 | 0.0170 |
| 2 | Comp. ex. | 0.074 | 3.42 | 0.074 | 0.023 | — | 0.15 | 0.0260 | 0.0051 | 0.13 | — | — | 0.0015 | 0.0170 |
| 3 | Comp. ex. | 0.074 | 3.42 | 0.074 | 0.023 | — | 0.15 | 0.0260 | 0.0051 | 0.13 | — | — | 0.0015 | 0.0170 |
| 4 | Comp. ex. | 0.074 | 3.42 | 0.075 | 0.023 | — | 0.15 | 0.0260 | 0.0051 | 0.13 | — | — | 0.0015 | 0.0170 |
| 5 | Comp. ex. | 0.074 | 3.42 | 0.075 | 0.023 | — | 0.15 | 0.0260 | 0.0051 | 0.13 | — | — | 0.0015 | 0.0170 |
| 6 | Inv. ex. | 0.078 | 3.30 | 0.072 | 0.008 | 0.020 | 0.11 | 0.0265 | 0.0044 | — | 0.040 | 0.01 | 0.0013 | 0.0187 |
| 7 | Comp. ex. | 0.078 | 3.30 | 0.072 | 0.008 | 0.020 | 0.11 | 0.0265 | 0.0044 | — | 0.040 | 0.01 | 0.0013 | 0.0187 |
| 8 | Comp. ex. | 0.078 | 3.30 | 0.072 | 0.008 | 0.020 | 0.11 | 0.0265 | 0.0044 | — | 0.040 | 0.01 | 0.0013 | 0.0187 |
| 9 | Comp. ex. | 0.078 | 3.30 | 0.072 | 0.008 | 0.020 | 0.11 | 0.0265 | 0.0044 | — | 0.040 | 0.01 | 0.0013 | 0.0187 |
| 10 | Comp. ex. | 0.078 | 3.30 | 0.072 | 0.008 | 0.020 | 0.11 | 0.0265 | 0.0044 | — | 0.040 | 0.01 | 0.0013 | 0.0187 |
| 11 | Inv. ex. | 0.069 | 3.41 | 0.070 | 0.065 | 0.018 | 0.09 | 0.0258 | 0.0047 | 0.14 | — | — | 0.0022 | 0.0180 |
| 12 | Comp. ex. | 0.070 | 3.45 | 0.069 | 0.060 | 0.019 | 0.10 | 0.0255 | 0.0045 | 0.15 | — | — | 0.0085 | 0.0216 |

TABLE 5

(continuation of Table 4)

| No. | Slab Re-heating temperature (° C.) | AlN precipitation ratio after hot-rolling (%) | Hot rolled strip annealing temperature (° C.) | Total nitridation amount ΔN (%) | Front surface nitridation amount σN1 (%) | Back surface nitridation amount σN2 (%) | Both surfaces nitridation ratio | Magnetic properties $B_8$(T) | Magnetic properties $W_{17/50}$(W/kg) |
|---|---|---|---|---|---|---|---|---|---|
| 1 | 1350 | 8.0 | 1120 | 0.0040 | 0.0021 | 0.0015 | 0.15 | 1.962 | 0.76 |
| 2 | 1350 | 8.5 | 1120 | 0.0134 | 0.0500 | 0.0480 | 0.15 | 1.880 | 0.99 |
| 3 | 1250 | 23.5 | 1120 | 0.0040 | 0.0017 | 0.0011 | 0.15 | Magnetic failure: Skid marks | |
| 4 | 1350 | 9.0 | 1120 | 0.0100 | 0.0068 | 0.0028 | 0.40 | Poor secondary recrystallization | |
| 5 | 1350 | 8.3 | 1245 | 0.0100 | 0.0050 | 0.0040 | 0.10 | Poor secondary recrystallization | |
| 6 | 1330 | 9.0 | 1100 | 0.0045 | 0.0024 | 0.0019 | 0.11 | 1.963 | 0.76 |
| 7 | 1330 | 9.5 | 1100 | 0.0130 | 0.0066 | 0.0050 | 0.12 | 1.899 | 0.98 |
| 8 | 1240 | 25.6 | 1100 | 0.0040 | 0.0015 | 0.0010 | 0.13 | Magnetic failure: Skid marks | |
| 9 | 1335 | 11.0 | 1100 | 0.0060 | 0.0047 | 0.0020 | 0.45 | Poor secondary recrystallization | |
| 10 | 1340 | 10.0 | 1230 | 0.0054 | 0.0026 | 0.0020 | 0.11 | Poor secondary recrystallization | |
| 11 | 1335 | 9.8 | 1100 | 0.0060 | 0.0030 | 0.0025 | 0.08 | 1.960 | 0.79 |
| 12 | 1335 | 8.8 | 1100 | 0.0060 | 0.0031 | 0.0026 | 0.08 | Poor secondary recrystallization | |

Example 3

A 2.3 mm hot rolled steel strip obtained under the same conditions as Example 2 was pickled without annealing cold rolled to 1.5 mm, annealed at the highest temperature shown in Table 4 for 30 seconds for intermediate annealing, then annealed at 930° C. for 60 seconds and cooled at a rate of 20° C./sec. After that, it was rolled at a temperature of 200° C. to 250° C. to 0.22 mm. After that, it was decarburization annealed at 850° C. for 110 seconds in a mixed atmosphere of $H_2$ and $N_2$ at a dew point of 65° C., then was nitrided while running the steel strip in an ammonia atmosphere. After that, the strip was coated with an annealing separator mainly consisting of MgO, then was annealed by secondary recrystallization annealing. The secondary recrystallization annealing was performed in an atmosphere of $N_2$=25% and $H_2$=75% by heating up the temperature to 1200° C. at a rate of 10 to 20° C./hour. After that, the strip was purified at a temperature of 1200° C. for 20 hours or more in an atmosphere of $H_2$=100%. After that, the strip was coated with the usually used insulation tension coating and then flattened. The results are shown in Table 6 and Table 7 (continuation of Table 6). As shown in Table 6 and Table 7, the steels of the present invention had high magnetic properties, particularly high $B_8$.

TABLE 6

| No. | Class | Chemical compositions at melting (mass %) C | Si | Mn | S | Se | Cu | sAl | N | Sn | Sb | Mo | Ti | $AlN_R$ |
|---|---|---|---|---|---|---|---|---|---|---|---|---|---|---|
| 1 | Inv. ex. | 0.074 | 3.42 | 0.074 | 0.023 | — | 0.15 | 0.0260 | 0.0051 | 0.13 | — | — | 0.0015 | 0.0170 |
| 2 | Comp. ex. | 0.074 | 3.42 | 0.074 | 0.023 | — | 0.15 | 0.0260 | 0.0051 | 0.13 | — | — | 0.0015 | 0.0170 |
| 3 | Comp. ex. | 0.074 | 3.42 | 0.074 | 0.023 | — | 0.15 | 0.0260 | 0.0051 | 0.13 | — | — | 0.0015 | 0.0170 |
| 4 | Comp. ex. | 0.074 | 3.42 | 0.075 | 0.023 | — | 0.15 | 0.0260 | 0.0051 | 0.13 | — | — | 0.0015 | 0.0170 |
| 5 | Comp. ex. | 0.074 | 3.42 | 0.075 | 0.023 | — | 0.15 | 0.0260 | 0.0051 | 0.13 | — | — | 0.0015 | 0.0170 |
| 6 | Inv. ex. | 0.078 | 3.30 | 0.072 | 0.008 | 0.020 | 0.11 | 0.0265 | 0.0044 | — | 0.040 | 0.01 | 0.0013 | 0.0187 |
| 7 | Comp. ex. | 0.078 | 3.30 | 0.072 | 0.008 | 0.020 | 0.11 | 0.0265 | 0.0044 | — | 0.040 | 0.01 | 0.0013 | 0.0187 |
| 8 | Comp. ex. | 0.078 | 3.30 | 0.072 | 0.008 | 0.020 | 0.11 | 0.0265 | 0.0044 | — | 0.040 | 0.01 | 0.0013 | 0.0187 |
| 9 | Comp. ex. | 0.078 | 3.30 | 0.072 | 0.008 | 0.020 | 0.11 | 0.0265 | 0.0044 | — | 0.040 | 0.01 | 0.0013 | 0.0187 |
| 10 | Comp. ex. | 0.078 | 3.30 | 0.072 | 0.008 | 0.020 | 0.11 | 0.0265 | 0.0044 | — | 0.040 | 0.01 | 0.0013 | 0.0187 |

TABLE 7

(Continuation of Table 6)

| No. | Slab Re-heating temperature (° C.) | AlN precipitation ratio after hot-rolling (%) | Hot rolled strip annealing temperature (° C.) | Total nitridation amount ΔN (%) | Front surface nitridation amount σN1 (%) | Back surface nitridation amount σN2 (%) | Both surfaces nitridation ratio | Magnetic properties $B_8$(T) | Magnetic properties $W_{17/50}$(W/kg) |
|---|---|---|---|---|---|---|---|---|---|
| 1 | 1350 | 8.0 | 1120 | 0.0040 | 0.0020 | 0.0014 | 0.15 | 1.954 | 0.78 |
| 2 | 1350 | 8.5 | 1120 | 0.0134 | 0.0070 | 0.0050 | 0.15 | 1.850 | 1.01 |
| 3 | 1250 | 23.5 | 1120 | 0.0040 | 0.0017 | 0.0011 | 0.15 | Magnetic failure: Skid marks | |
| 4 | 1350 | 9.0 | 1120 | 0.0100 | 0.0065 | 0.0025 | 0.40 | Poor secondary recrystallization | |
| 5 | 1350 | 8.3 | 1245 | 0.0100 | 0.0050 | 0.0040 | 0.10 | Poor secondary recrystallization | |
| 6 | 1330 | 9.0 | 1100 | 0.0045 | 0.0025 | 0.0020 | 0.11 | 1.958 | 0.77 |
| 7 | 1330 | 9.5 | 1100 | 0.0130 | 0.0071 | 0.0055 | 0.12 | 1.882 | 0.99 |
| 8 | 1240 | 25.6 | 1100 | 0.0040 | 0.0019 | 0.0014 | 0.13 | Magnetic failure: Skid marks | |
| 9 | 1335 | 11.0 | 1100 | 0.0060 | 0.0045 | 0.0022 | 0.38 | Poor secondary recrystallization | |
| 10 | 1340 | 10.0 | 1230 | 0.0054 | 0.0030 | 0.0024 | 0.11 | Poor secondary recrystallization | |

Example 4

A large number of specimens treated up to the decarburization annealing under the same conditions as those for No. 1 of Table 2 used in Example 1 were prepared. These were nitrided while adjusting the ammonia concentration in the atmosphere above and below the steel strip to prepare variously changed specimens. Next, these were coated with an annealing separator mainly consisting of MgO, annealed by secondary recrystallization annealing, coated with an insulation tension coating, and flattened under the same conditions as those in Example 1. The results thereof are shown in FIG. 1. As shown in FIG. 1, the steels of the present invention had high magnetic properties, particularly high $B_8$.

INDUSTRIAL APPLICABILITY

In the present invention, the ultra-high temperature at the time of the hot rolling heating of the conventional grain oriented electrical steel sheet is avoided and, at the same time, the bad influence of low temperature heating is eliminated, so production of a grain oriented electrical steel sheet extremely excellent in magnetic properties becomes possible.

The invention claimed is:

1. A method of production of a grain-oriented electrical steel sheet extremely excellent in magnetic properties comprising the steps of:

reheating a slab comprising, by mass %, C: 0.025 to 0.10%, Si: 2.5 to 4.0%, Mn: 0.04 to 0.15%, solAl: 0.020 to 0.035%, N: 0.002 to 0.007%, S and Se, as Seq (S equivalents)=S+0.406×Se, 0.010 to 0.035%, Ti 0.007%, and a balance of Fe and unavoidable impurities to 1280° C. or more for dissolving inhibitor substances, hot rolling the slab into a hot rolled steel strip, annealing the hot rolled steel strip, cold rolling the steel strip one or more times with a rolling reduction ratio of more than 80% and less than 92% while intermediate annealing the steel strip before the last rolling, or omitting the annealing of the hot rolled steel strip and cold rolling the steel strip two or more times while intermediate annealing the steel strip before the last rolling, decarburization annealing the cold rolled steel strip at a temperature range of 650° C. to 950° C. for 80 to 300 seconds in a mixed gas of hydrogen and nitrogen with a wet atmosphere for decarburizing carbon content and controlling primary recrystallized grains having a circle equivalent mean size (diameter) of more than 7 μm to less than 20 μm, applying nitridation to the decarburized steel strip in a mixed gas of hydrogen, nitrogen and ammonia for controlling the increased N content (ΔN %) within the range defined by Equation (1), and further controlling the increased N content (ΔN %) at one surface of the steel strip (σN1, mass %) and the increased N content (ΔN %) at the other surface of the steel strip (σN2, mass %) in a 20% thickness portion of the surface of the steel strip to within the range defined by Equation (2), coating an annealing separator mainly composed of MgO to the steel strip, and secondary recrystallization annealing the coated steel strip, $$0.007-([N]-14/48\times[Ti])\leqq\Delta N\leqq[solAl]\times14/27-([N]-14/48\times[Ti])+0.0025 \quad \text{Equation (1)}$$

$$|\sigma N1-\sigma N2|/\Delta N\leqq0.35 \quad \text{Equation (2)}$$

wherein in Equation (1), [N], [Ti] and [Sol Al] represent respectively N, Ti and Sol Al contents (mass %) in the steel strip.

2. A method of production of a grain-oriented electrical steel sheet extremely excellent in magnetic properties as set forth in claim 1, wherein the highest temperature T1 (° C.) of the step of annealing of the hot rolled strip annealing and the step of intermediate annealing is 950° C. or more and within a range determined by Equation (4) according to an $AlN_R$ defined by Equation (3) from the solAl, N, and Ti contents:

$$AlN_R=[solAl]-27/14\times[N]+27/48\times[Ti] \quad \text{Equation (3)}$$

$$3850/3-4/3\times AlN_R\times10000\leqq Ti(0°\ C.)\leqq4370/3-4/3\times AlN_R\times10000 \quad \text{Equation (4)}$$

wherein, in Equation (1), [N], [Ti] and [Sol Al] represent respectively N, Ti and Sol Al contents (mass %) in the steel strip.

3. A method of production of a grain-oriented electrical steel sheet extremely excellent in magnetic properties as set forth in claim 2, wherein the step of intermediate annealing is carried out in one stage at a temperature within the range of T1(° C.) defined by Equation (4) for 20 to 360 seconds.

4. A method of production of a grain-oriented electrical steel sheet extremely excellent in magnetic properties as set forth in claim 2, wherein the step of intermediate annealing is carried out in two stages, the first stage at a temperature within the range of T1(° C.) defined by Equation (4) for 5 to 120 seconds, and the second stage at a temperature within a range of from 850 to 1000° C. for 10 seconds to 240 seconds.

5. A method of production of a grain-oriented electrical steel sheet extremely excellent in magnetic properties as set forth in claim 1, further comprising the step of cooling the steel strip from 700° C. to 300° C. in after the step of intermediate annealing at a cooling rate of 10° C./sec or more.

6. A method of production of a grain-oriented electrical steel sheet extremely excellent in magnetic properties as set forth in claim 1, wherein the slab further contains, by mass %, Cu: 0.05 to 0.30%, one or more of Sn, Sb, and P in total of 0.02 to 0.30%, and Cr: 0.02 to 0.30%.

7. A method of production of a grain-oriented electrical steel sheet extremely excellent in magnetic properties as set forth in claim 1, further comprising the step of holding the steel strip within a temperature range from 100 to 300° C. for 1 minute or more in at least one pass of the last cold rolling.

8. A method of production of a grain-oriented electrical steel sheet extremely excellent in magnetic properties as set forth in claim 1, further comprising the step of regulating a heating rate in the step of decarburization and nitrization annealing from the start of temperature rise up to 650° C. 100° C./sec or more.

* * * * *